US007416424B1

(12) United States Patent
Deckman

(10) Patent No.: US 7,416,424 B1
(45) Date of Patent: Aug. 26, 2008

(54) FLASH DRIVE CAP ATTACHMENT

(76) Inventor: Margaret Deckman, 528 Hamilton St., Norristown, PA (US) 19401

( * ) Notice: Subject to any disclaimer, the term of this patent is extended or adjusted under 35 U.S.C. 154(b) by 0 days.

(21) Appl. No.: 11/800,764

(22) Filed: May 7, 2007

(51) Int. Cl.
*H01R 13/44* (2006.01)

(52) U.S. Cl. ..... 439/135

(58) Field of Classification Search ..... 439/135, 439/136

See application file for complete search history.

(56) References Cited

U.S. PATENT DOCUMENTS 5,082,111 A * 1/1992 Corbitt et al. ..... 206/363
5,352,042 A * 10/1994 Roy ..... 383/6
6,179,654 B1 * 1/2001 Witkowski et al. ..... 439/550
D475,359 S 6/2003 Hirose
6,676,422 B1 * 1/2004 Baker et al. ..... 439/135
6,733,329 B2 5/2004 Yang
6,980,422 B2 12/2005 Bhogal
D538,223 S * 3/2007 Yang ..... D13/107
2005/0130471 A1 6/2005 Regen et al.
2006/0038023 A1 2/2006 Brewer et al.
2006/0082963 A1 4/2006 Chen
2007/0161365 A1 * 7/2007 Chen ..... 455/347

* cited by examiner

*Primary Examiner*—Neil Abrams
*Assistant Examiner*—Phuong Nguyen

(57) ABSTRACT

The invention is a flash drive cap attachment system comprising a cap strip connected to a flexible cord, which is also connected to a body strip. The attachment system attaches to both the body and cap of a USB flash drive. The main feature of this invention is to eliminate the loss of the removable cap.

2 Claims, 3 Drawing Sheets

FLASH DRIVE CAP ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of portable flash drives, more specifically a flash drive cap attachment.

There are many USB flash drives on the market that have a removable cap that when removed, enables the electrical contacts of the flash drive to be inserted into a USB port. This invention seeks to eliminate the unwanted, and often accidental, loss of the removable caps by providing an attachment clip that securely attaches to both the body of the flash drive and the removable cap. The loss of the removable cap may cause damage to the electrical connections on the flash drive.

B. Discussion of the Prior Art

The Brewer et al. Patent Application Publication (U.S. Pub. No. 2006/0038023) discloses a memory system comprising a memory unit enclosed within a housing that enables the electrical contacts of the memory system to be exposed when needed for contact with a mating element located outside of the housing. However, the system disclosed under the Brewer Publication does not have a removable cap that covers the electrical contacts of which an attachment clip is provided to prevent the loss of the removable cap.

The Regen et al. Patent Application Publication (U.S. Pub. No. 2005/0130471) discloses a thumb drive comprising an on-board memory for storing digital information, which may be attached to another object. However, the thumb drive disclosed under the Regen Publication does not have a removable cap with an attachment clip that prevents the loss of the removable cap.

The Bhogal patent (U.S. Pat. No. 6,980,422) discloses a method and system for internally connecting a Universal Serial Bus device to a computer. However, the method and system disclosed under the Bhogal patent does not involve a flash drive having a removable cap with an attachment clip.

The Yang patent (U.S. Pat. No. 6,733,329) discloses a USB flash drive that includes a mobile storage device and at least one interconnector. However, the flash drive disclosed under the Yang patent is not directed to a removable cap having an attachment clip that prevents the loss of the removable cap that fits over the USB electrical contacts.

The Chen Patent Application Publication (U.S. Pub. No. 2006/0082963) discloses a USB drive mass storage device having a housing provided at an end with, for example, a USB connector, and at the other end with at least one card slot for different types of memory cards. However, the USB drive mass storage device disclosed under the Chen Publication is not directed to a removable cap that has an attachment clip that prevents the loss of the removable cap.

The Hirose patent (U.S. Pat. No. Des. 475,359) illustrates a design for a flash drive, which does not include a removable cap with an attachment clip.

In light of the above discussed prior art there is a need for USB flash drives having removable caps to provide an attachment clip that when installed will prevent the accidental loss of the removable caps associated with the normal use of the USB flash drive.

BRIEF SUMMARY OF THE INVENTION

The invention is a flash drive cap attachment system comprising a cap strip connected to a flexible cord, which is also connected to a body strip. The attachment system attaches to both the body and cap of a USB flash drive. The main feature of this invention is to eliminate the loss of the removable cap.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
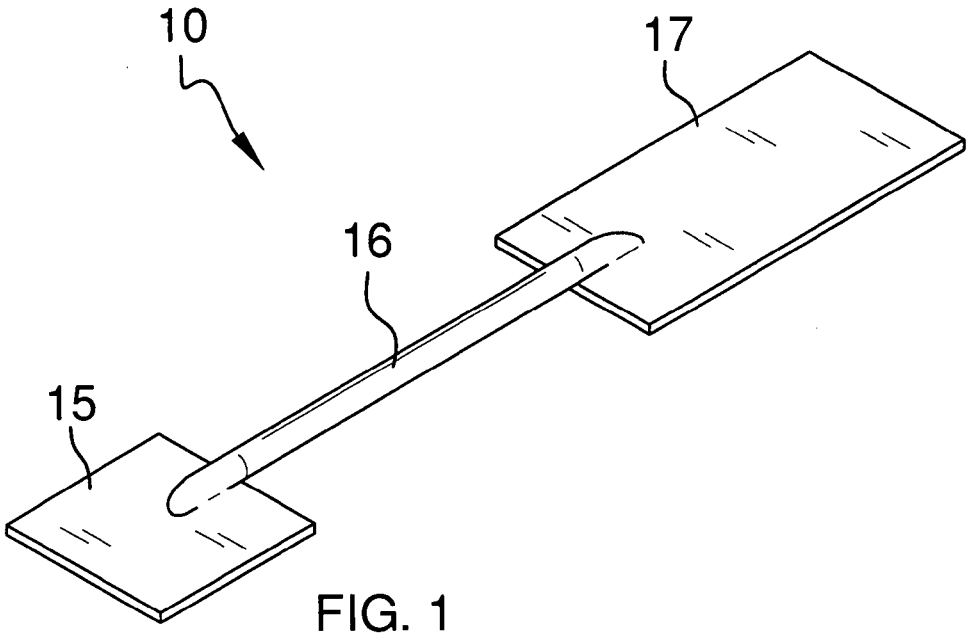
FIG. 1 illustrates a front, isometric view of the device by itself.
Figure 2:
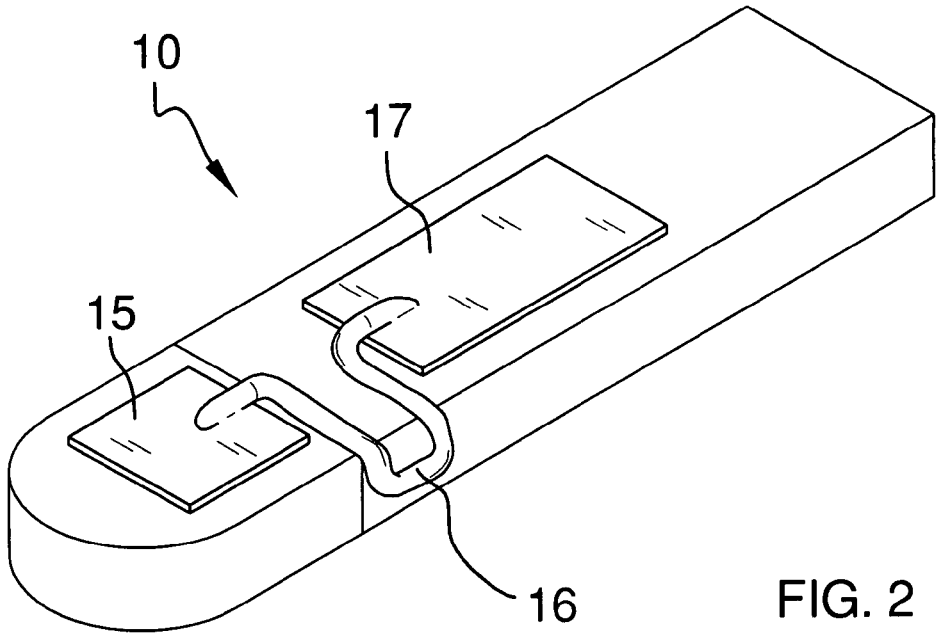
FIG. 2 illustrates a front, isometric view of the device installed on a flash drive with a removable cap.
Figure 3:
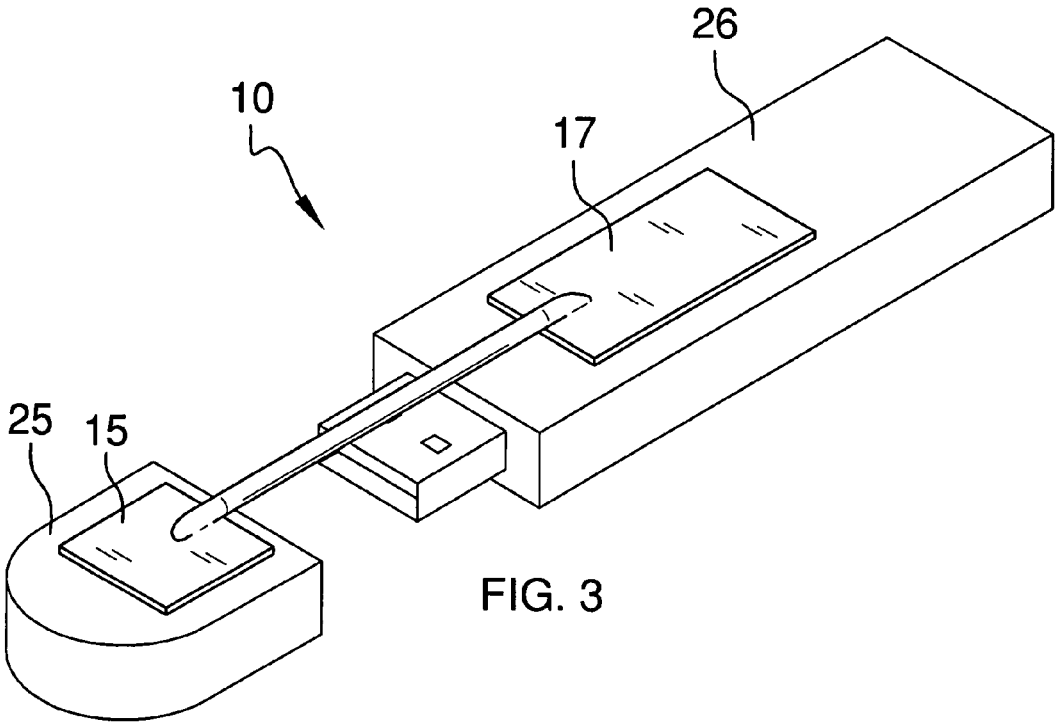
FIG. 3 illustrates a front, isometric view of the device installed on a flash drive having the removable cap separated from the body of the flash drive.
Figure 4:
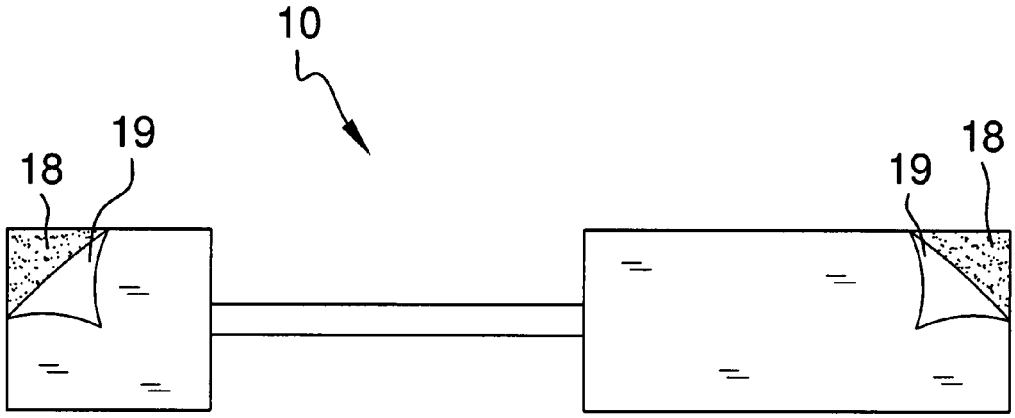
FIG. 4 illustrates a side view of the device by itself.
Figure 5:
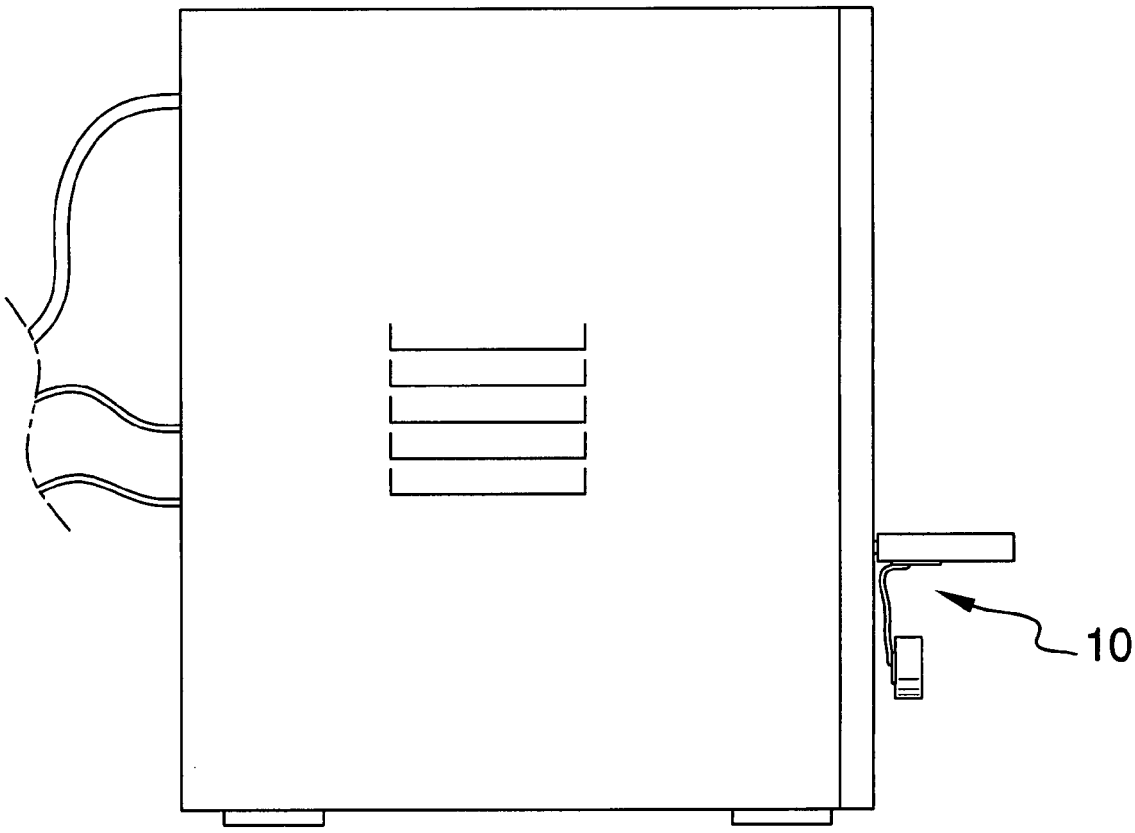
FIG. 5 illustrates the device in use.

Detailed reference will now be made to the preferred embodiments of the present invention, examples of which are illustrated in FIGS. 1-5. An attachment clip 10 consists of a cap strip 15, a flexible cord 16, and a body strip 17. Located on both the cap strip 15 and the body strip 17 is a layer of adhesive 18, which is exposed upon removing the removable strip 19.

The attachment clip 10 is installed by removing the removable strip 19 from the cap strip 15 and placing the cap strip 15 with the layer of adhesive 18 facing a removable cap 25. Next, remove the removable strip 19 from the body strip 17 and place the body strip with the layer of adhesive 18 facing a flash drive body 26. It shall be noted that the location of the body strip 17 with respect to the cap strip 15 should be less than half the total distance of the flexible cord 16 so as to insure ease of use of the attachment clip 10.

The invention claimed is:

1. An attachment clip for use with a flash drive comprising:

(a) a cap strip;

wherein a first layer of adhesive is located along one side of the cap strip;

wherein the cap strip is attached to a cap of a flash drive via the first adhesive layer;

(b) a body strip; and wherein a second layer of adhesive is located along one side of the body strip;

wherein the body strip is attached to a flash drive body via the second adhesive layer;

(c) a flexible cord;

wherein the cap strip is permanently attached to the flexible cord;

wherein the body strip is permanently attached to the flexible cord;

wherein a removable strip is placed over the layer of adhesive until the attachment clip is to be installed.

2. The attachment clip for use with a flash drive of claim 1 wherein the cap strip and the body strip are made of a durable plastic.

* * * * *